US005926966A

United States Patent [19]

Russell

[11] Patent Number: 5,926,966

[45] Date of Patent: Jul. 27, 1999

[54] TEMPLATE SET FOR CUTTING PATCHES

[76] Inventor: Mary Russell, P.O. Box 12445, San Luis Obispo, Calif. 93406

[21] Appl. No.: 08/847,531

[22] Filed: Apr. 2, 1997

[51] Int. Cl.[6] ..... G01B 3/14

[52] U.S. Cl. ..... 33/562; 33/565; 33/2 R

[58] Field of Search ..... 33/562, 563, 565, 33/500, 27.01, 23.11, 2 R, 566

[56] References Cited

U.S. PATENT DOCUMENTS

| | | | |
|---|---|---|---|
| D. 163,411 | 3/1951 | Picken | 33/563 |
| 2,407,019 | 6/1946 | Cree | 33/562 |
| 2,805,485 | 9/1957 | Krummel | 33/2 R |
| 4,185,391 | 1/1980 | Roley | 33/563 |
| 4,712,309 | 12/1987 | Kingston et al. | 33/562 |

FOREIGN PATENT DOCUMENTS

| | | | |
|---|---|---|---|
| 2245815 | 1/1992 | United Kingdom | 33/2 R |

*Primary Examiner*—Diego Gutierrez
*Assistant Examiner*—Maria Fernandez
*Attorney, Agent, or Firm*—Daniel C. McKown

[57] ABSTRACT

A set of two templates for use in cutting patches, each patch having first and second straight sides that in general are not parallel, whereby the patches can be arranged in a sequence with the first straight side of each patch except the first patch collinear with the second straight side of the previous patch, and with the second straight side of each patch except the last patch collinear with the first straight side of the next patch. The shape of the first template is the shape of the sequence of patches. The second template includes a sheet of a transparent material having a straight edge and bearing markings showing the successive patches in the sequence arranged along the straight edge and oriented so that the second straight side of each patch, except the last patch, is collinear with the straight edge.

3 Claims, 4 Drawing Sheets

TEMPLATE SET FOR CUTTING PATCHES

CROSS REFERENCE TO RELATED APPLICATIONS

Not applicable.

STATEMENT RE FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

The present invention is in the field of quilting equipment and specifically relates to a set of two templates to facilitate repetitive cutting of a specific number of patches having various shapes, each patch having two straight sides.

2. The Prior Art

The use of a template or pattern to define the size and shape of a single patch has long been known. Also, when quantities of a single patch are needed, it is known to cut a number of layers of the material simultaneously, using the template as a guide.

The present invention is concerned with the situation where a number of patches of different shapes must be supplied in quantity. Typically, the patches in question will be sewn together to form a block, and the block will be repeated throughout a quilt.

One could cut out a number of repetitions of a first patch, and then cut out a number of repetitions of a second patch, and so on, until the required number of each has been cut out. This process is not efficient, either in terms of the time required or in terms of minimizing the amount of fabric required.

The present inventor has found a more efficient way of cutting the patches that is usable when each of the patches includes two straight sides.

BRIEF SUMMARY OF THE INVENTION

It is an object of the present invention to provide an efficient way to produce a specific number of patches having various shapes, so long as each patch has two straight edges.

In practicing the present invention, it is convenient to make a set of surrogate patches having the same size and shape as the patches that are to be produced in quantity, but made of a stiffer material to facilitate handling. These surrogate patches could be made of a transparent material so that the decorative pattern of the underlying material can be seen as it will appear on the finished product.

These surrogate patches may be arranged on the fabric to be cut in any arrangement that seems advantageous so long as the straight sides of the surrogate patches are collinear. It is not essential, in practicing the invention, for the straight sides of the patches to be of equal length, although that is helpful.

Once the surrogate patches have been arranged in a chosen sequence, a template is produced having a shape corresponding to the shape of the arrangement of patches. This first template is then used to guide the cutting of one or more layers of fabric.

Next, a second template is produced. It consists of a sheet of a transparent material on which markings indicating the shapes of the individual patches are arrayed along a straight edge. The markings are oriented along the straight edge in such a way that one of the straight sides of each patch is collinear with the straight edge of the template. Also, the markings showing the patches are arrayed along the straight edge in the same sequence that they occur in the original arrangement.

This second template is then laid over the stack of pieces that have been cut to the shape of the first template in such a way that the first patch outline on the second template coincides with the portion of the piece that will become the first patch when a cut is made along the straight edge of the second template. This process is repeated until only the last patch remains.

The increase in efficiency, compared with cutting the patches individually derives from the fact that when the present invention is used, a single cut defines a straight edge on two patches. If the patches were cut individually, and there were N patches, the number of straight line cuts would equal 2N. When the present invention is used, the number of straight line cuts is reduced to N−1, thereby saving N+1 straight line cuts.

As will be shown below, other advantages result from using the present invention. The second template always bears down on the patch being cut, thereby preventing it from creeping during the cutting. Also, because the patch outlines on the second template are in the same sequence as the patches are arranged, the template is always moved one step toward the user as each successive edge is cut. Simultaneously, the material being cut is always fed into the template from the same side. These movements are natural or instinctive, and the entire process requires rather little concentration.

The novel features which are believed to be characteristic of the invention, both as to structure and operating procedure, together with further objects and advantages thereof, will be better understood from the following description considered in connection with the accompanying drawings in which two preferred embodiments of the invention are illustrated by way of example. It is to be expressly understood, however, that the drawings are for the purpose of illustration and description only and are not intended as a definition of the limits of the invention.

DETAILED DESCRIPTION OF THE INVENTION

The present invention is a set of two templates that facilitate the repetitive cutting of a specific number of patches having various shapes, where each patch has two straight edges. Two preferred embodiments will be described in detail. The structure and use of the first preferred embodiment will be described in connection with FIGS. 1–7, and the structure and use of the second preferred embodiment will be described in connection with FIGS. 8–14.

Typically, in quilting, a number of patches will be sewn together to form a block, and this block is then repeated at designated locations throughout a quilt. For example, in the popular Double Wedding Ring pattern, six patches of different shapes are joined in a sequence to form an arch, and the arch is repeated throughout the quilt. The present invention is concerned with the problem of making less tedious the cutting of the individual patches that make up the arch.

It should be understood that the present invention is not limited to the Double Wedding Ring pattern; the benefits of the present invention are available so long as it is desired to cut out a number of patches having different shapes but each having two straight sides. It is helpful, but not absolutely necessary that the straight sides be of equal length.

Figure 1:
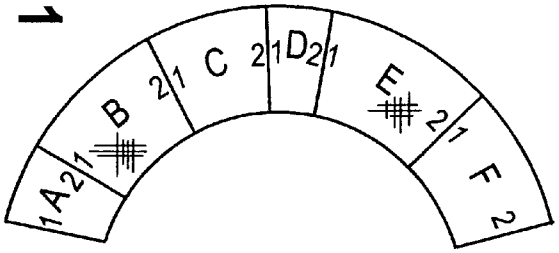
FIG. 1 is a diagram showing an arrangement of six patches.

FIG. 1 shows a number of patches, each having two straight sides and positioned so that the straight sides of adjacent patches are collinear. The patches shown in FIG. 1 may be composed of cloth, or they may be paper or cardboard patterns having the same shape as the patches. The sequence and the orientation of the individual patches in the arrangement of FIG. 1 is determined by the user based on a number of considerations. For example, the patch material may have stripes or a particular ornamental pattern and it may be preferable to orient some of the patches in a particular orientation relative to the pattern. Another consideration could be the direction of stretch if a stretchable fabric is used, or the direction of maximum shrinkage if that is a consideration. Another consideration is that the resulting shape should be one that can be repetitively cut from a sheet of material with minimum wastage. Finally, it is desirable that the resulting arrangement should be easily cut, suggesting that straight lines and long smooth curves are preferable to more intricate patterns.

It is assumed that the user has considered all these possibilities and has selected the arrangement of patches shown in FIG. 1. The selection process is not part of the present invention which is independent of the arrangement chosen. For ease of explanation, the successive patches in the arrangement of FIG. 1 are designated by the letters A, B, . . . F. Also, for convenience of explanation, the straight sides of each patch are designated by the numerals 1 and 2.

Figure 8:
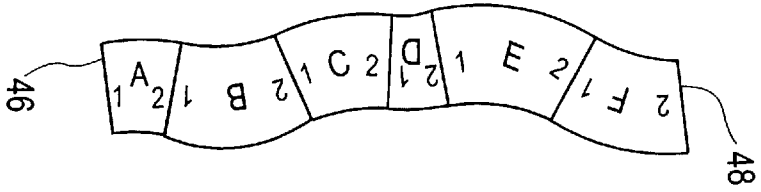
FIG. 8 is a diagram showing a transformed arrangement of the six patches shown in FIG. 1.

The arrangement that the user decides on, after considering the aforementioned factors, may have a different shape than the shape that the block will have when the patches are sewn together. For example, the patches shown in FIG. 1 could be arranged as shown in FIG. 8 for purposes of cutting the patches, which can then be sewn together to form the block shown in FIG. 1.

Figure 2:
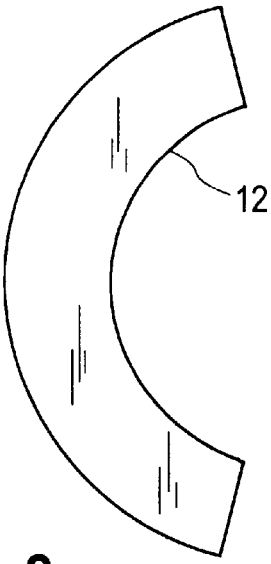
FIG. 2 is a top plan view of a first template in a first preferred embodiment for cutting out the arrangement of patches shown in FIG. 1.

The outline of the chosen arrangement of patches shown in FIG. 1 is then traced onto a sheet of a preferably stiff material from which the traced shape is cut to form the first template 12 shown in FIG. 2. This first template does not need to be transparent, although it may be.

Next, the first template 12 is used to cut a number of pieces of fabric, each having the shape of the first template. Normally, a stack of several layers of fabric would be cut in a single operation.

Figure 3:
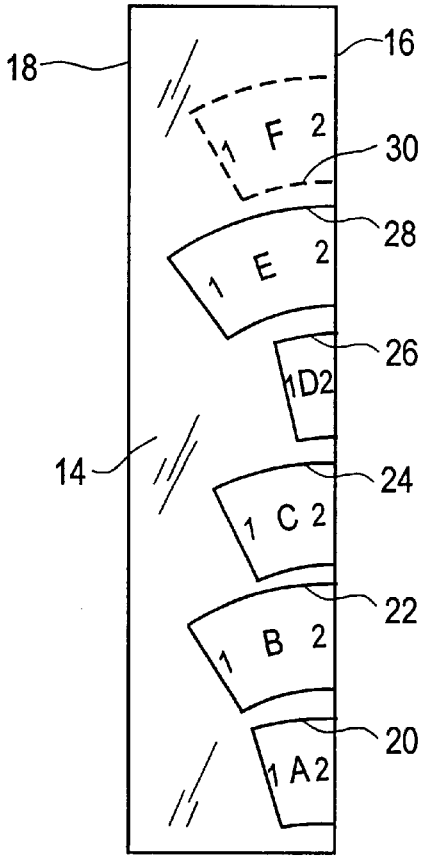
FIG. 3 is a top plan view of a second template in the first preferred embodiment for cutting out the individual patches of the arrangement of FIG. 1.

Next, a second template 14, shown in FIG. 3 is produced. It is composed of a sheet of a transparent material having one straight edge 16. So long as it has a straight edge 16, the periphery of the second template can have any convenient shape. For example, it may have a second straight edge 18 with markings that permit it to be used as a ruler. Another possibility is that the width or length of the second template may correspond to particular dimensions that are significant relative to the quilt. In yet another variation the second template may bear markings in the form of lines indicating a desired margin, allowance, or sewing expanse. The features, implemented by various markings that could be applied to the second template, are optional; only the markings 20, 22, 24, 26, and 28 defining the shape of all but the last patch are essential. Even a marking 30 having the shape of the last patch in the sequence is optional, but is included in the preferred embodiment. In accordance with the preferred embodiment, the shapes of the patches marked on the second template 14 do not overlap, although in other embodiments they may overlap. Further in accordance with the present invention, the second straight edge of each patch is collinear with the straight edge 16 of the second template 14.

FIGS. 4–7 are a sequence showing successive stages in using the second template 14. Those figures are drawn to a smaller scale than FIGS. 1–3.

Figure 4:
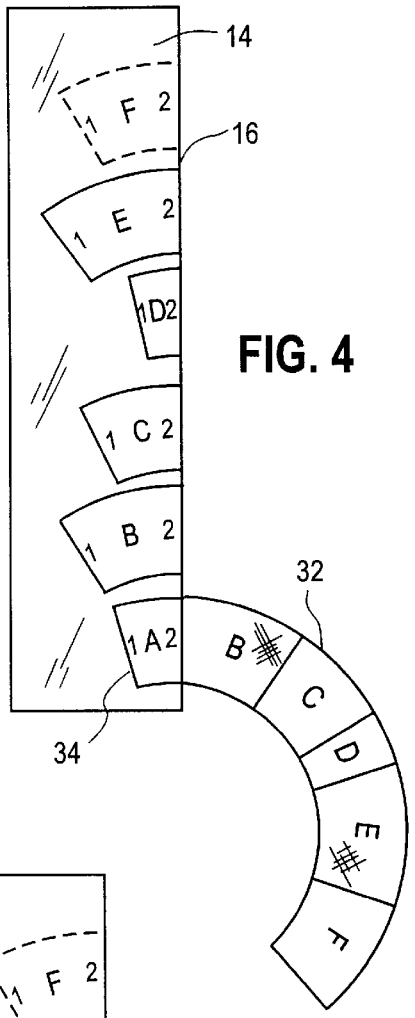
FIG. 4 is a diagram showing a first step in using the second template of FIG. 3 in successively cutting out the individual patches of the arrangement of FIG. 1.

The first template 12, shown in FIG. 2, has already been used to cut out a number of pieces, which are stacked in congruence to form the stack 32 of FIG. 4. As shown in FIG. 4, the second template 16 is brought down upon the stack 32 and oriented so that the end 34 of the stack 32 is in registration with the marking 20 that defines the shape of the first patch, patch A. The second template 16 is then pressed down upon the stack 32, and the stack is cut using the straight edge 16 as a cutting guide. This operation produces a number of copies of patch A.

Next, the end 36 of the stack is brought into registration with the marking 22 of the second template 14, and another cut is made along the straight edge 16. This creates a stack of patches having the shape of patch B.

Figure 6:
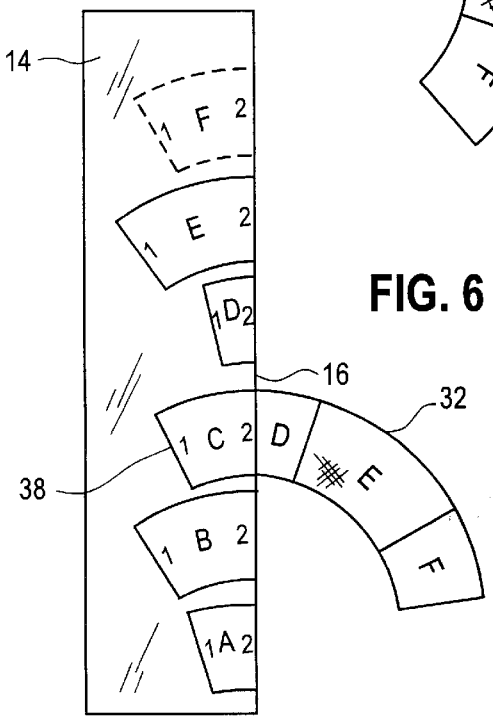
FIG. 6 is a diagram showing a third step in using the second template of FIG. 3 in successively cutting out the individual patches of the arrangement of FIG. 1.

In FIG. 6, the remaining end 38 of the stack 32 is brought into registration with the marking 24 that defines the shape of patch C, and again, a cut is made along the straight edge 16.

Figure 5:
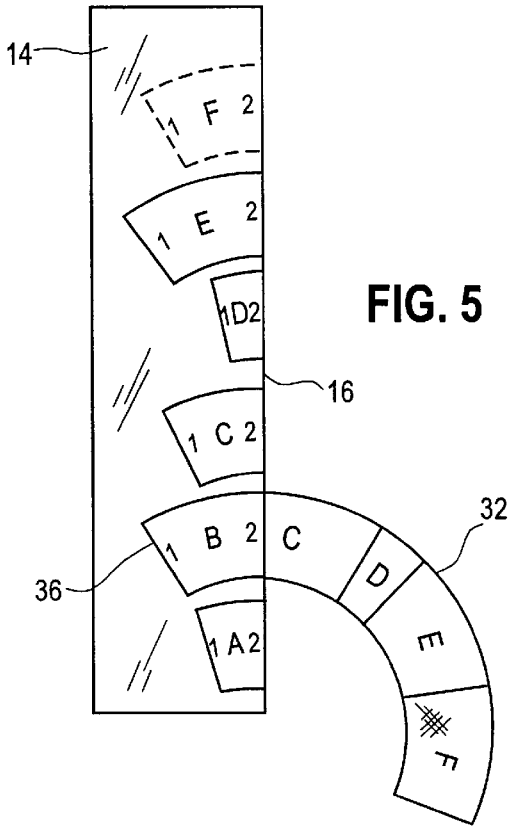
FIG. 5 is a diagram showing a second step in using the second template of FIG. 3 in successively cutting out the individual patches of the arrangement of FIG. 1.
Figure 7:
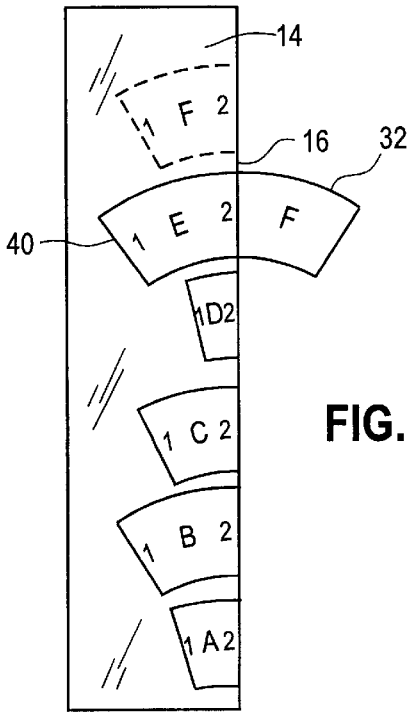
FIG. 7 is a diagram showing a later step in using the second template of FIG. 3 in successively cutting out the individual patches of the arrangement of FIG. 1.

The process of FIGS. 4, 5, and 6 is repeated for the cutting of patch D. Then, as shown in FIG. 7, the remaining end 40 of the stack 32 is brought into registration with the marking 28 defining the shape of patch E. A final cut is then made along the straight edge 16, and it should be noted that this cut serves to separate patch E from the last patch F.

The marking 30 on the second template 14 may be used for checking the shape of the patch F.

As a result of the operations of FIGS. 4–7, each of the patches A, B, . . . F has been reproduced a number of times. Note that the six patches A, B, . . . F have been produced with only five cuts along the straight edge 16.

In reviewing FIGS. 4–7, it is seen that the stack 32 is always advanced from right to left, while the second template 14 is shifted toward the user in successive steps. These motions are particularly convenient and natural for a right-handed person. For a left-handed person, a more appropriate second template would be obtained by turning the template 14 over about the straight line 16. In this case, the stack 32 would be fed from left to right but the template would still be moved progressively toward the user.

Once the individual patches have been cut, they may be sewn together as the user chooses, and as pointed out above, not necessarily in the arrangement shown in FIG. 1.

Figure 9:
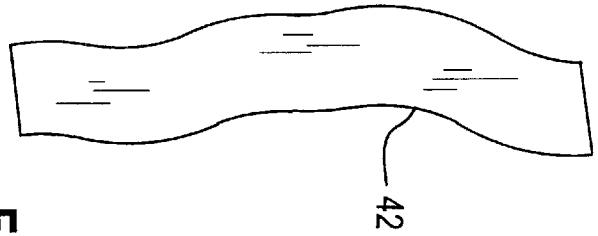
FIG. 9 is a top plan view of a first template in a second preferred embodiment for cutting out the transformed arrangement of patches shown in FIG. 8.
Figure 10:
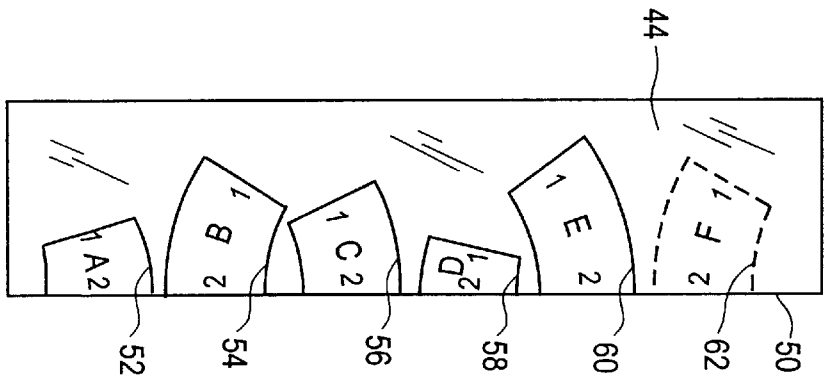
FIG. 10 is a top plan view of a second template in a second preferred embodiment for cutting out the individual patches of the transformed arrangement of FIG. 8.

FIGS. 8–14 are concerned with a second preferred embodiment of the present invention. Like the first embodiment, the second preferred embodiment includes a first template 42 and a second template 44, shown in FIGS. 9 and 10, respectively. It is immediately clear that the first template 42 of FIG. 9 is quite different from the first template 12 of FIG. 2. Likewise, the second template 44 of FIG. 10 is quite different from the second template 14 of FIG. 3. Notwithstanding these apparent differences, both embodiments are comprehended within a single inventive concept, as will be seen below and as recited in the claims that follow. Both embodiments produce the same number of patches of each shape, and the embodiments are equally easy to use.

A comparison of FIG. 1 with FIG. 8 shows that the same patches, A through F, are used in each arrangement. The arrangement of FIG. 8 differs from that of FIG. 1 in that every other patch has been reoriented so that its first and second sides are interchanged.

After the patches have been arranged in the arrangement shown in FIG. 8, the straight sides of the patches are numbered with the numerals 1 and 2 in the manner shown in FIG. 8; namely, so that the first side of the first patch (A) is the free end 46 of the arrangement, and so that the first straight side of each succeeding patch is collinear with the second straight side of the previous patch, and so that the second end of the last patch also is the second end 48 of the sequence of patches.

Note that the arrangement of patches in FIG. 8 has a less curved shape than the arrangement of FIG. 1, and, arguably, the arrangement of FIG. 8 should be easier to cut out. Alternatively, it might be found that the arrangement of FIG. 8 can be cut from a sheet of cloth with less wastage than the arrangement of FIG. 1. The point is that there may be valid reasons for preferring one arrangement of patches over another, and thus the fact that many arrangements are possible is of more than theoretical interest.

The outline of the arrangement of FIG. 8 is traced onto a stiff material, and the resulting figure is then cut from the material to become the first template 42 of FIG. 9 of this second preferred embodiment.

The second template 44 of this second preferred embodiment is shown in FIG. 10. It includes a straight edge 50 and is composed of a sheet of a transparent material. Along the straight edge 50, markings 52, 54, 56, 58, and 60 showing the successive patches A, B, . . . E are arrayed. The order of the patches along the straight edge 50 is the same as the order of patches in the arrangement of FIG. 8. Note that the markings 52–60 denoting the patches are oriented so that the second side of each of the patches coincides with the straight line 50. A marking 62 for the last patch in the sequence may optionally be included.

FIGS. 11–14 are a sequence of diagrams drawn to a smaller scale than FIGS. 8–10, and showing successive stages in the use of the second template 44.

Figure 11:
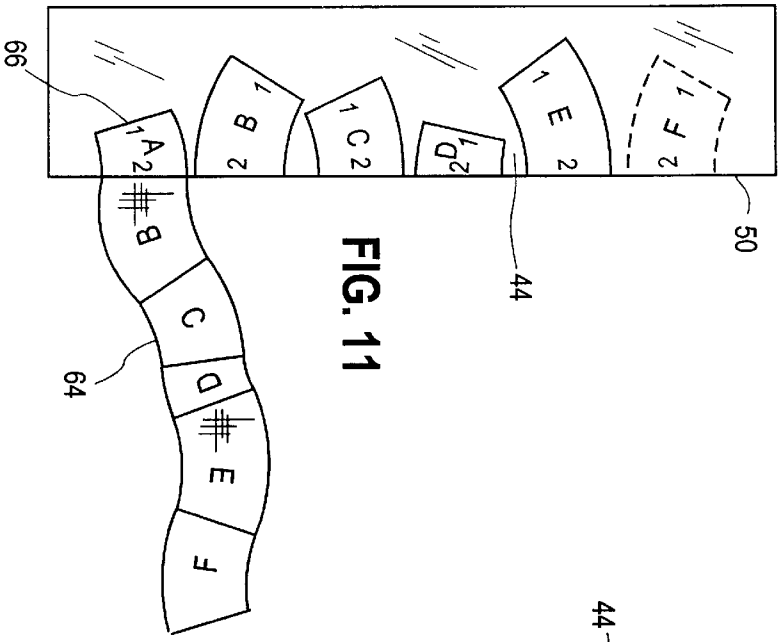
FIG. 11 is a diagram showing a first step in using the second template of FIG. 10 in successively cutting out the individual patches of the transformed arrangement of FIG. 8.

A stack of pieces having the shape of the first template 42 are cut by using the first template 42 as a cutting guide. As seen in FIG. 11, the second template 44 is then laid on top of the stack 64 and oriented so that the first end 66 is registered with the marking 52 of the second template. A cut is then made along the straight edge 50, thereby producing a number of copies of patch A.

Figure 12:
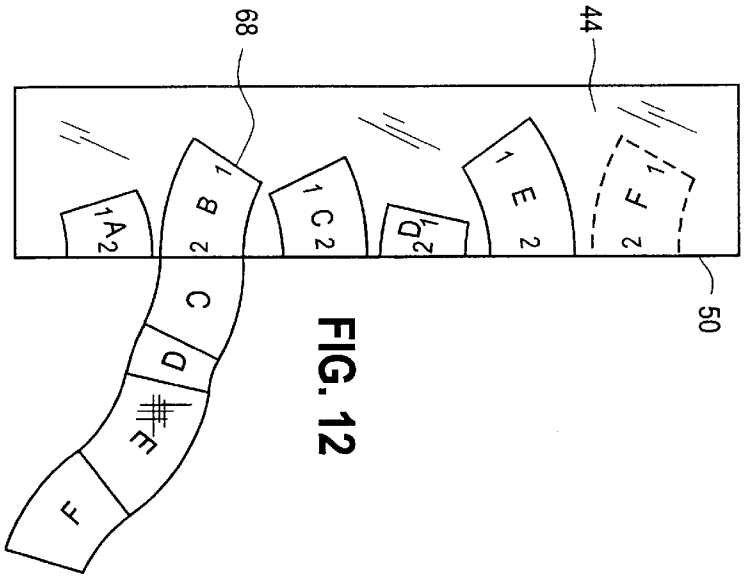
FIG. 12 is a diagram showing a second step in using the second template of FIG. 10 in successively cutting out the individual patches of the transformed arrangement of FIG. 8.

Referring now to FIG. 12, the end 68 of the stack 64 is advanced leftward under the template 44 until it registers with the marking 54 of the second template. A cut is then made along the straight edge 50 thereby producing the patches having shape B.

Figure 13:
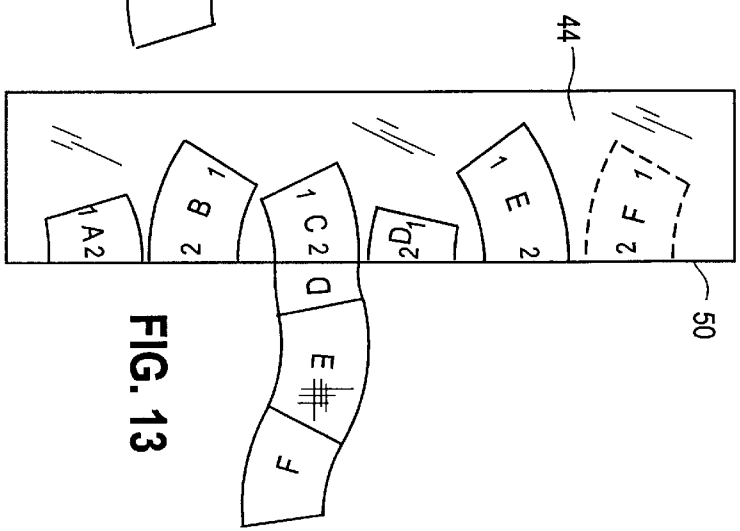
FIG. 13 is a diagram showing a third step in using the second template of FIG. 10 in successively cutting out the individual patches of the transformed arrangement of FIG. 8; and, FIG. 14 is a diagram showing a later step in using the second template of FIG. 10 in successively cutting out the individual patches of the transformed arrangement of FIG. 8.
Figure 14:
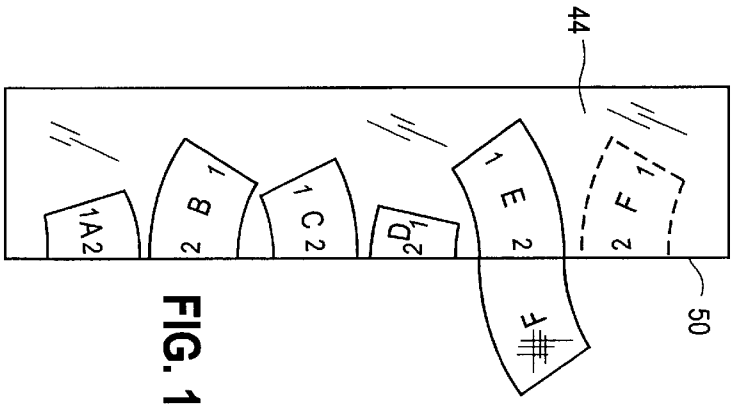

As seen in FIGS. 13 and 14, the process is continued until the final cut along the straight edge 50 in FIG. 14 separates the patch E from the last patch F.

Note that even though the templates 42 and 44 in the second preferred embodiment have a different appearance from the templates 12 and 14 of the first preferred embodiment, the end result is exactly the same.

The number of arrangements, of the type shown in FIG. 1, comprehended by the present invention is larger than might initially be thought. Accordingly, the present invention comprehends a vast number of sets of templates, all of which appear to be different. The first and second preferred embodiments described above are only two possible sets chosen from the vast number for illustrative purposes. Let N denote the number of patches in the arrangement, where N is an integer greater than one.

An arrangement may be built up by adding successive patches until all N patches have been used. The first patch may be any one of the N patches. The second patch may be any one of the N−1 remaining patches.

There are four ways of joining the second patch to the first patch; either straight side of the second patch may be aligned with either straight side of the first patch. The joined sides cannot be joined to anything else, and the combination of the first and second patches has only two straight sides available for joining. A third patch may be selected from the remaining N−2 patches, and either side of it may be joined to either of the two available sides of the combined first and second patches; thus there are four ways of adding the third patch.

Continuing in this manner, there would appear to be $N!4^{N-1}$ ways of forming an arrangement. However, it must be considered that each arrangement has an identical twin, obtained by starting with the last patch and adding the patches in the reverse order. For example, in FIG. 1, exactly the same final arrangement results if the arrangement is started with patch F and then patches E, D, C, B and A are added. Accordingly, the true number of arrangements is $(1/2)N!4^{N-1}$. The following table gives the number of possible arrangements of N different patches, each having exactly two straight sides:

| N | 2 | 3 | 4 | 5 | 6 |
|---|---|---|---|---|---|
| Arrangements | 4 | 48 | 768 | 15,360 | 368,640 |

Some of the patches may be identical. In this case they should still be included in the arrangement and in the first template. Whether the repetitions should be shown on the second template is a matter of choice. If only the first of several identical patches is shown on the second template, the user must remember to re-use the single marking of the patch on the second template, and this opens up an opportunity for errors to occur. By including markings on the second template for the repeated patches, the process retains its desirable undemanding nature.

Thus, there have been described two preferred embodiments of a set of two templates for use in cutting patches, where each patch has two straight sides that in general are not parallel. The use of the templates facilitates the cutting of a number of copies of each of several patches.

I claim:

1. A set of two templates for use in cutting patches, each patch having first and second straight sides that in general are not parallel to each other, whereby the patches can be arranged in a sequence with the first straight side of each patch, except the first patch, being collinear with the second straight side of the previous patch, and with the second straight side of each patch, except the last patch, being collinear with the first straight side of the next patch, said set of two templates comprising:

a first template, having first and second straight sides that in general are not parallel to each other and conforming to the sequence of patches; and, a second template including a sheet of a transparent material having a straight edge and bearing markings showing the successive patches in the sequence arranged along the straight edge and oriented so that the second straight side of each patch, except the last patch, is collinear with the straight edge.

2. The set of two templates of claim 1 wherein said first and said second straight sides of the first template are of equal length.

3. A set of two templates for the efficient cutting of quilt patches, each patch having two straight opposite sides that in general are not parallel, a convex side and a concave side, so that the patches can be arranged in an arch with their straight sides touching, the convex sides extending in succession to form one side of the arch and the concave sides extending in succession to form the other side of the arch, said set of two templates comprising:

a first template having two straight opposite sides that in general are not parallel to each other, a convex side and a concave side, forming a shape that results from rotating every other patch in the arch so that its convex side joins the concave sides of the patches on either side of it, whereby its concave side joins the convex sides of the patches on either side of it; and, a second template composed of a sheet of a transparent material having a straight edge and bearing markings showing the successive patches in the arch arrayed along the straight edge and rotated so that the second straight edge of each patch that adjoins the next patch along the first template lies along the straight edge of said second template.

* * * * *